US011414942B2

(12) United States Patent
Al Yahya et al.

(10) Patent No.: US 11,414,942 B2
(45) Date of Patent: Aug. 16, 2022

(54) PACKER INSTALLATION SYSTEMS AND RELATED METHODS

(71) Applicant: Saudi Arabian Oil Company, Dhahran (SA)

(72) Inventors: Hany Al Yahya, Qatif (SA); Mario Augusto Rivas Martinez, Dhahran (SA)

(73) Assignee: Saudi Arabian Oil Company, Dhahran (SA)

( * ) Notice: Subject to any disclaimer, the term of this patent is extended or adjusted under 35 U.S.C. 154(b) by 106 days.

(21) Appl. No.: 17/070,165

(22) Filed: Oct. 14, 2020

(65) Prior Publication Data

US 2022/0112783 A1 Apr. 14, 2022

(51) Int. Cl.
*E21B 37/00* (2006.01)
*E21B 23/06* (2006.01)
*E21B 33/12* (2006.01)

(52) U.S. Cl.
CPC ..... *E21B 23/06* (2013.01); *E21B 33/12* (2013.01); *E21B 37/00* (2013.01)

(58) Field of Classification Search
CPC .. E21B 23/06; E21B 33/12; E21B 37/00–045; E21B 12/06
See application file for complete search history.

(56) References Cited

U.S. PATENT DOCUMENTS 1,812,044 A 6/1931 Grant
2,169,502 A 8/1939 Santiago
2,179,475 A * 11/1939 Still ..... E21B 37/02 166/174
2,190,145 A * 2/1940 Braden ..... E21B 37/02 166/174
2,298,985 A * 10/1942 Still ..... E21B 37/02 166/170
2,499,916 A 3/1950 Harris
2,671,515 A * 3/1954 Hall ..... E21B 37/02 166/173

(Continued)

FOREIGN PATENT DOCUMENTS

CN 103688015 3/2014
CN 204177988 2/2015

(Continued)

OTHER PUBLICATIONS

Engineering Innovation Worldwide, "TIW XPAK Liner Hanger System brochure," 2015 TIW Corporation, Houston TX , TIW0001D Jun. 2015, retrieved from URL <http://www.tiwoiltools.com/Images/Interior/downloads/tiw_xpak_brochure.pdf>. 4 pages.

(Continued)

*Primary Examiner* — Steven A Macdonald
(74) *Attorney, Agent, or Firm* — Fish & Richardson P.C.

(57) ABSTRACT

A packer installation system includes a pipe, a packer that is secured to the pipe at a first axial position along the pipe, and a brush assembly that is secured to the pipe at a second axial position. The brush assembly includes brushes that are adjustable between a first configuration in which the brushes extend radially from the pipe by a first distance and a second configuration in which the brushes extend radially from the pipe by a second distance that is greater than the first distance.

16 Claims, 5 Drawing Sheets

(56) References Cited

U.S. PATENT DOCUMENTS 2,959,224 A 11/1960 Ault
3,335,801 A 8/1967 Wilsey
3,425,500 A 2/1969 Fuchs
3,483,934 A 12/1969 Fuchs
3,557,875 A 1/1971 Solum et al.
4,058,163 A 11/1977 Yandell
4,384,625 A 5/1983 Roper et al.
4,399,873 A 8/1983 Lindsey, Jr.
4,458,761 A 7/1984 Van Vreeswyk
4,482,014 A 11/1984 Allwin et al.
4,501,322 A * 2/1985 Martin ..... E21B 37/08 166/173
4,646,842 A 3/1987 Arnold et al.
4,674,569 A 6/1987 Revils et al.
4,681,159 A 7/1987 Allwin et al.
4,693,328 A 9/1987 Furse et al.
4,846,290 A 7/1989 Jones
4,852,654 A 8/1989 Buckner
4,855,820 A 8/1989 Barbour
4,944,348 A 7/1990 Whiteley et al.
4,993,493 A 2/1991 Arnold
5,152,342 A 10/1992 Rankin et al.
5,390,742 A 2/1995 Dines et al.
5,819,353 A * 10/1998 Armell ..... E21B 37/02 166/173
5,947,213 A 9/1999 Angle
6,009,948 A 1/2000 Flanders et al.
RE36,556 E 2/2000 Smith
6,152,221 A 11/2000 Carmicheal et al.
6,163,257 A 12/2000 Tracy
6,234,250 B1 5/2001 Green et al.
6,378,628 B1 4/2002 McGuire et al.
6,527,066 B1 3/2003 Rives
6,550,534 B2 4/2003 Brett
6,577,244 B1 6/2003 Clark et al.
6,662,110 B1 12/2003 Bargach et al.
6,684,953 B2 2/2004 Sonnier
6,691,779 B1 2/2004 Sezginer et al.
6,739,398 B1 5/2004 Yokley et al.
6,752,216 B2 6/2004 Coon
6,873,267 B1 3/2005 Tubel et al.
6,896,064 B2 5/2005 Howlett et al.
6,899,178 B2 5/2005 Tubel
6,938,698 B2 9/2005 Coronado
7,096,950 B2 8/2006 Howlett et al.
7,219,730 B2 5/2007 Tilton et al.
7,228,902 B2 6/2007 Oppelt
7,228,910 B2 6/2007 Howlett et al.
7,243,735 B2 7/2007 Koederitz et al.
7,252,152 B2 8/2007 LoGiudice et al.
7,278,492 B2 10/2007 Braddick
7,419,001 B2 9/2008 Broussard
7,581,440 B2 9/2009 Meek
7,654,334 B2 2/2010 Manson
7,665,537 B2 2/2010 Patel et al.
7,677,303 B2 3/2010 Coronado
7,938,192 B2 5/2011 Rytlewski
7,940,302 B2 5/2011 Mehrotra et al.
8,028,767 B2 10/2011 Radford et al.
8,102,238 B2 1/2012 Golander et al.
8,191,635 B2 6/2012 Buske et al.
8,237,585 B2 8/2012 Zimmerman
8,334,775 B2 12/2012 Tapp et al.
8,424,605 B1 4/2013 Schultz et al.
8,448,724 B2 5/2013 Buske et al.
8,469,084 B2 6/2013 Clark et al.
8,528,668 B2 9/2013 Rasheed
8,540,035 B2 9/2013 Xu et al.
8,750,513 B2 6/2014 Renkis
8,789,585 B2 7/2014 Leising et al.
8,800,655 B1 8/2014 Bailey
8,833,472 B2 9/2014 Hay
8,919,431 B2 12/2014 Lott
8,925,213 B2 1/2015 Sallwasser
8,991,489 B2 3/2015 Redlinger et al.
9,051,792 B2 6/2015 Herberg et al.
9,091,148 B2 7/2015 Moffitt et al.
9,121,255 B2 9/2015 Themig et al.
9,133,666 B2 9/2015 Lee
9,140,100 B2 9/2015 Daccord et al.
9,157,294 B2 10/2015 Kleppa et al.
9,187,959 B2 11/2015 Treviranus et al.
9,208,676 B2 12/2015 Fadell et al.
9,341,027 B2 5/2016 Radford et al.
9,494,003 B1 11/2016 Carr
9,506,318 B1 11/2016 Brunet
9,546,536 B2 1/2017 Schultz et al.
9,752,403 B1 * 9/2017 Frey ..... E21B 33/138
9,988,878 B2 6/2018 Ali et al.
11,047,210 B2 * 6/2021 Hora ..... E21B 41/0035
2001/0040035 A1 11/2001 Appleton et al.
2002/0053434 A1 5/2002 Chen et al.
2002/0070018 A1 6/2002 Buyaert
2002/0148607 A1 10/2002 Pabst
2003/0001753 A1 1/2003 Cernocky et al.
2004/0060741 A1 4/2004 Shipalesky et al.
2004/0069496 A1 4/2004 Hosie et al.
2004/0089323 A1 * 5/2004 Hatley ..... E21B 37/02 134/8
2004/0134687 A1 7/2004 Radford et al.
2004/0156264 A1 8/2004 Gardner et al.
2004/0177967 A1 9/2004 Hirth
2005/0273302 A1 12/2005 Huang et al.
2006/0081375 A1 4/2006 Ruttley
2006/0086497 A1 4/2006 Ohmer et al.
2006/0107061 A1 5/2006 Holovacs
2006/0260799 A1 11/2006 Broussard
2006/0290528 A1 12/2006 MacPherson et al.
2007/0057811 A1 3/2007 Mehta
2007/0107911 A1 5/2007 Miller et al.
2007/0187112 A1 8/2007 Eddison et al.
2007/0261855 A1 11/2007 Brunet
2008/0029263 A1 * 2/2008 Palmer ..... E21B 27/005 166/99
2008/0041631 A1 2/2008 Vail, III
2008/0115574 A1 5/2008 Meek
2008/0264636 A1 10/2008 Stromquist et al.
2009/0045974 A1 2/2009 Patel
2009/0050333 A1 2/2009 Smith
2009/0114448 A1 5/2009 Laird et al.
2009/0145666 A1 6/2009 Radford et al.
2009/0218100 A1 * 9/2009 Williams ..... E21B 28/00 166/173
2009/0223670 A1 9/2009 Snider
2009/0289808 A1 11/2009 Prammer
2009/0301723 A1 12/2009 Gray
2010/0097205 A1 4/2010 Script
2010/0101786 A1 4/2010 Lovell et al.
2010/0139981 A1 6/2010 Meister et al.
2010/0212891 A1 8/2010 Stewart et al.
2010/0212900 A1 8/2010 Eddison et al.
2010/0212901 A1 8/2010 Buytaert
2010/0258297 A1 10/2010 Lyndre
2010/0258298 A1 10/2010 Lynde et al.
2010/0282511 A1 11/2010 Maranuk et al.
2011/0031023 A1 2/2011 Menezes et al.
2011/0067884 A1 3/2011 Burleson et al.
2011/0073329 A1 3/2011 Clemens et al.
2011/0100645 A1 5/2011 Yapici
2011/0127044 A1 6/2011 Radford et al.
2011/0147014 A1 6/2011 Chen et al.
2011/0240302 A1 10/2011 Coludrovich, III
2011/0266004 A1 11/2011 Hallundbaek et al.
2012/0048571 A1 3/2012 Radford et al.
2012/0085540 A1 4/2012 Heijnen
2012/0175135 A1 7/2012 Dyer et al.
2012/0211229 A1 8/2012 Fielder
2012/0211280 A1 8/2012 Dewey et al.
2012/0241154 A1 9/2012 Zhou
2012/0247767 A1 10/2012 Themig et al.
2012/0307051 A1 12/2012 Welter
2012/0312560 A1 12/2012 Bahr et al.
2013/0128697 A1 5/2013 Contant
2013/0153245 A1 6/2013 Knobloch et al.

(56) References Cited

U.S. PATENT DOCUMENTS

| | | | | |
|---|---|---|---|---|
| 2013/0186645 | A1 | 7/2013 | Hall | |
| 2013/0292175 | A1 | 11/2013 | Radford et al. | |
| 2013/0299160 | A1 | 11/2013 | Lott | |
| 2014/0060844 | A1 | 3/2014 | Barbour et al. | |
| 2014/0083769 | A1 | 3/2014 | Moriarty et al. | |
| 2014/0090898 | A1 | 4/2014 | Moriarty et al. | |
| 2014/0126330 | A1 | 5/2014 | Shampine et al. | |
| 2014/0131036 | A1 | 5/2014 | Huval et al. | |
| 2014/0139681 | A1 | 5/2014 | Jones, Jr. et al. | |
| 2014/0150822 | A1* | 6/2014 | Osaland | B08B 9/045 134/8 |
| 2014/0166367 | A1 | 6/2014 | Campbell et al. | |
| 2014/0172306 | A1 | 6/2014 | Brannigan | |
| 2014/0208847 | A1 | 7/2014 | Baranov | |
| 2014/0308203 | A1 | 10/2014 | Sheinberg et al. | |
| 2015/0027706 | A1 | 1/2015 | Symms | |
| 2015/0090459 | A1 | 4/2015 | Cain et al. | |
| 2015/0101863 | A1 | 4/2015 | Jeffryes | |
| 2015/0101864 | A1 | 4/2015 | May | |
| 2015/0152713 | A1 | 6/2015 | Garcia et al. | |
| 2015/0176362 | A1 | 6/2015 | Prieto | |
| 2015/0226009 | A1 | 8/2015 | Claudey et al. | |
| 2015/0267500 | A1 | 9/2015 | Van Dongen et al. | |
| 2015/0308203 | A1 | 10/2015 | Lewis | |
| 2016/0061006 | A1* | 3/2016 | Krueger | E21B 37/02 166/174 |
| 2016/0160578 | A1 | 6/2016 | Lee | |
| 2016/0215612 | A1 | 7/2016 | Morrow | |
| 2016/0230508 | A1 | 8/2016 | Jensen | |
| 2016/0237764 | A1 | 8/2016 | Jellison et al. | |
| 2016/0237768 | A1 | 8/2016 | Jamison et al. | |
| 2016/0305219 | A1* | 10/2016 | Holloway | E21B 23/06 |
| 2016/0312582 | A1* | 10/2016 | Ali | E21B 37/02 |
| 2016/0356152 | A1 | 12/2016 | Croux | |
| 2017/0044834 | A1 | 2/2017 | Peters | |
| 2017/0067318 | A1 | 3/2017 | Haugland | |
| 2017/0074071 | A1 | 3/2017 | Tzallas et al. | |
| 2017/0159365 | A1 | 6/2017 | Solem | |
| 2018/0030810 | A1 | 2/2018 | Saldanha | |
| 2019/0055820 | A1* | 2/2019 | Coyle, Jr. | E21B 37/02 |
| 2019/0292896 | A1 | 9/2019 | Costa de Oliveira et al. | |
| 2020/0080400 | A1* | 3/2020 | Garcia | E21B 37/04 |
| 2020/0190947 | A1 | 6/2020 | Micak | |

FOREIGN PATENT DOCUMENTS

| | | |
|---|---|---|
| DK | 2569506 | 7/2017 |
| EP | 0377234 | 10/1989 |
| EP | 0618345 | 10/1994 |
| EP | 2157278 | 2/2010 |
| EP | 2692982 | 5/2014 |
| EP | 2835493 | 2/2015 |
| GB | 2157743 | 10/1985 |
| GB | 2194571 | 3/1988 |
| GB | 2261238 | 12/1993 |
| GB | 2460096 | 11/2009 |
| GB | 2470762 | 12/2010 |
| WO | WO 2003058545 | 7/2003 |
| WO | WO 2010049723 | 5/2010 |
| WO | WO 2011038170 | 3/2011 |
| WO | WO 2011095600 | 8/2011 |
| WO | WO 2011159890 | 12/2011 |
| WO | WO 2012156735 | 11/2012 |
| WO | WO 2016144345 | 9/2016 |

OTHER PUBLICATIONS

Engineersedge.com [online], "ACME Stub Threads Size Designation Table Chart," retrieved URL <http://www.engineersedge.com/hardware/acme-stub-thread.htm>, retrieved on Feb. 27, 2017, 2 pages.

Mi Swaco: A Schlumberger Company, "Intelligent Fluids Monitoring System," available on or before Mar. 11, 2015, retrieved on May 1, 2018, retrieved from URL: <https://www.slb.com/resources/other_resources/brochures/miswaco/intelligent_fluids_monitoring_brochure.aspx>, 8 pages.

Offshore-mag.com [online], "Completions Technology: Large monobore completions prevent high-volume gas well flow restrictions," Dec. 1, 2001, retrieved on Feb. 27, 2017, retrieved from URL <http://www.offshore-mag.com/articles/print/volume-61/issue-12/news/completions-technology-large-monobore-completions-prevent-high-vol. gas-well-flow-restrictions.html>, 9 pages.

PCT International Search Report and Written Opinion in International Appln. No. PCT/US2021/054385, dated Jan. 27, 2022, 15 pages.

* cited by examiner

PACKER INSTALLATION SYSTEMS AND RELATED METHODS

TECHNICAL FIELD

This disclosure relates to packer installation systems and related methods of securing a packer within a pipe.

BACKGROUND

Setting of a packer within a pipe may be compromised due to debris that has accumulated along an interior surface of the pipe. The debris can sometimes reduce the quality of a seal between the packer and the pipe once the packer has been set. Accordingly, a scraper may need to be deployed to a pipe in a separate cleanout run that is dedicated solely to cleaning an interior surface of the pipe along a setting section before a packer can even be deployed and set within the pipe. Carrying out such a cleanout run can delay operations and also introduce additional costs associated with labor and equipment.

SUMMARY

This disclosure relates to packer installation systems that are designed to clean out a pipe along a setting section of the pipe and to set a packer along the setting section in a single run. An example packer installation system includes a pipe segment of a drill string, a packer that is secured to the pipe segment for sealing an annular region between the drill string and the pipe, and a brush assembly that is secured to the pipe segment for removing debris that has accumulated on the pipe along the setting section. The brush assembly may be located above or below the packer, depending on a configuration of the packer and the pipe segment. The pipe segment is formed as a tubular wall that defines a central channel through which a cleaning fluid can be pumped in a downhole direction towards the packer at a high flow rate. The pipe segment also defines multiple small, circumferentially distributed holes through which the cleaning fluid can flow radially outward from the pipe segment at a high jetting force toward the pipe. The brush assembly is axially positioned adjacent the holes in the pipe segment and includes multiple, circumferentially distributed brushes that can be activated to mechanically scrape the debris from an internal wall surface of the pipe as cleaning fluid is jetted towards the pipe and coats the brushes. Combined actions of scraping the pipe with the brush assembly and jetting the cleaning fluid toward the pipe along the setting section sufficiently cleans the pipe for adequate securely setting the packer within the pipe along the setting section.

In one aspect, a packer installation system includes a pipe, a packer that is secured to the pipe at a first axial position along the pipe, and a brush assembly that is secured to the pipe at a second axial position. The brush assembly includes brushes that are adjustable between a first configuration in which the brushes extend radially from the pipe by a first distance and a second configuration in which the brushes extend radially from the pipe by a second distance that is greater than the first distance.

Embodiments may provide one or more of the following features.

In some embodiments, the pipe defines multiple openings that are distributed about a circumference of the pipe and that are positioned adjacent the brush assembly.

In some embodiments, the first axial position is above the second axial position.

In some embodiments, the first axial position is below the second axial position In some embodiments, the pipe is open at a bottom end of the pipe.

In some embodiments, the first configuration is a retracted configuration, and the second configuration is an extended configuration.

In some embodiments, the brushes are oriented horizontally in both the retracted and extended configurations.

In some embodiments, the brushes are biased to the extended configuration.

In some embodiments, the brush assembly includes an actuation system that is coupled to the brushes in the retracted configuration.

In some embodiments, the actuation system is configured to cause the brushes to move from the retracted configuration to the extended configuration.

In some embodiments, the actuation system includes a first support member, a second support member positioned axially below and spaced apart from the first support member, an actuation member that is supported by the first support member when the brushes are in the retracted configuration, pulling lines that connect the actuation member respectively to the brushes to secure the brushes in the retracted configuration, and a shear ball that is configured to move the actuation member.

In some embodiments, the first support member is movable in a downhole direction to abut the second support member.

In some embodiments, the shear ball is movable in the downhole direction from the first support member to the second support member to close a bottom end of the pipe segment.

In some embodiments, the actuation system is configured to cause breakage of the pulling lines to allow the brushes to move from the retracted configuration to the extended configuration.

In some embodiments, the actuation system is formed of one or more degradable materials.

In some embodiments, the pipe is closed at a bottom end of the pipe.

In some embodiments, the first configuration is a collapsed configuration, and the second configuration is an extended configuration.

In some embodiments, the brushes are configured to pivot radially outward from the collapsed configuration to the extended configuration.

In some embodiments, the brushes are oriented at an angle of about 90 degrees with respect to a central axis of the pipe in the extended configuration, and the brushes are oriented at an acute angle with respect to the central axis of the pipe in the collapsed configuration.

In some embodiments, the brush assembly further includes stops that are positioned to prevent the brushes from swinging more than 90 degrees away from the pipe segment in the extended configuration.

In another aspect, a method of installing a packer within a pipe includes pumping cleaning fluid in a downhole direction into a pipe segment that is disposed within the pipe and that carries the packer and extending multiple brushes carried on the pipe segment in a radially outward direction, where the multiple brushes are spaced axially apart from the packer and are positioned along a setting section of the pipe. The method further includes flowing the cleaning fluid through lateral openings in the pipe segment adjacent the multiple brushes in the radially outward direction towards an internal wall surface of the pipe, cleaning the internal wall surface of the pipe with the multiple brushes and with the cleaning fluid, aligning the packer axially with the setting section of the pipe, and securing the packer to the pipe along the setting section.

Embodiments may provide one or more of the following features.

In some embodiments, the method further includes rotating the pipe segment while the multiple brushes clean the internal wall surface of the pipe segment.

In some embodiments, the method further includes moving the pipe segment axially while the multiple brushes clean the internal wall surface of the pipe segment.

In some embodiments, the method further includes moving the packer in the downhole direction to align the packer with the setting section of the pipe.

In some embodiments, the method further includes moving the packer in an uphole direction to align the packer with the setting section of the pipe.

In some embodiments, the method further includes scraping the internal wall surface of the pipe with the multiple brushes.

In some embodiments, the method further includes coating the multiple brushes with the cleaning fluid.

In some embodiments, the method further includes moving the multiple brushes from a retracted configuration in which the brushes extend across a wall of the pipe segment to an extended configuration in which the multiple brushes are positioned along an external wall surface of the pipe segment.

In some embodiments, the multiple brushes are biased to the extended configuration.

In some embodiments, the brushes are maintained in the retracted configuration with an actuator that is disposed within the pipe segment and is initially connected to the multiple brushes.

In some embodiments, the method further includes closing a bottom end of the pipe segment with the actuator.

In some embodiments, the method further includes degrading the actuator to reestablish access to the pipe surrounding the pipe segment.

In some embodiments, the actuator includes a ball and a spring.

In some embodiments, the method further includes adjusting the multiple brushes from a collapsed configuration in which the multiple brushes are oriented at an acute angle with respect to a central axis of the pipe segment to an extended configuration in which the multiple brushes are oriented at an angle of about 90 degrees with respect to the central axis of the pipe segment.

In some embodiments, the method further includes pivoting the multiple brushes from the collapsed configuration into the extended configuration.

In some embodiments, the method further includes preventing the brushes from pivoting more than about 90 degrees with respect to the central axis of the pipe segment.

In some embodiments, the pipe segment is closed at a bottom end of the pipe.

In some embodiments, the method further includes sealing an annular region with the packer.

In some embodiments, the method further includes accumulating the cleaning fluid at a bottom end of the pipe segment.

In some embodiments, the method further includes forcing the cleaning fluid through the lateral openings in the pipe segment.

The details of one or more embodiments are set forth in the accompanying drawings and description. Other features, aspects, and advantages of the embodiments will become apparent from the description, drawings, and claims.

DETAILED DESCRIPTION

Figure 1:
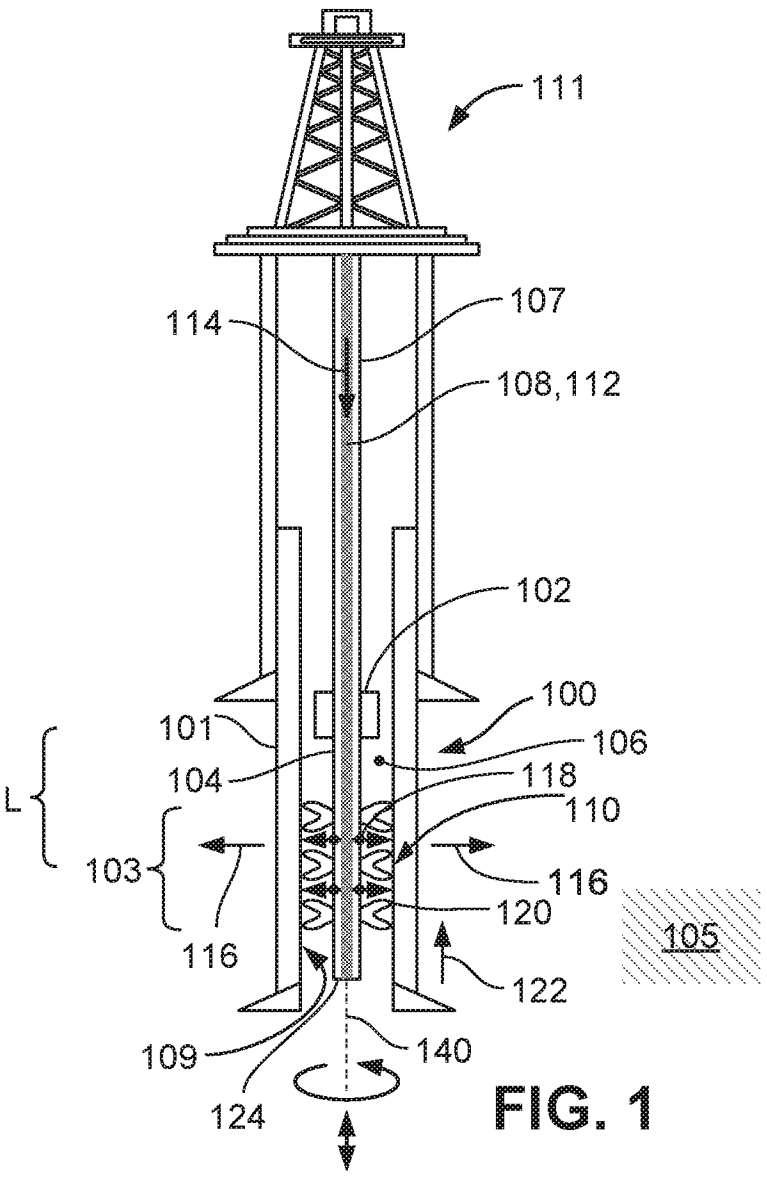
FIG. 1 is a side view of a packer installation system including a brush assembly that is positioned along a setting section of a pipe and a packer that is positioned above the brush assembly.

FIG. 1 illustrates an example packer installation system 100 that is designed to clean out a pipe 101 along a setting section 103 of the pipe 101 and to secure a packer 102 of the packer installation system 100 to the pipe 101 (for example, to set the packer 102 within the pipe 101) along the setting section 103 in a single run. In some embodiments, the packer 102 may be a production packer, a retrievable bridge plug, a service packer, or another type of packer. In some examples, the pipe 101 may be a completion tubing, a casing, or a liner that is installed beneath a rig 111 at a wellbore within a rock formation 105. The packer installation system 100 forms a part of a bottom hole assembly.

In addition to the packer 102, the packer installation system 100 includes a pipe segment 104 of a drill string 107 and a brush assembly 110 that is secured to the pipe segment 104 for removing debris (for example, tar, scale, rust, or other debris) that has accumulated on an internal wall surface 109 of the pipe 101 along the setting section 103. The packer 102 is secured to the pipe segment 104 for sealing an annular region 106 defined between the drill string 107 and the pipe 101. In the example packer installation system 100, the brush assembly 110 is located below the packer 102, as may sometimes be the case when the packer 102 is a permanent packer such that the brush assembly 110 is located away from the production path.

The pipe segment 104 is formed as a tubular wall that defines a central channel 108 through which a cleaning fluid 112 can be pumped in a downhole direction 114 towards the packer 102 at a high flow rate. The pipe segment 104 also defines multiple small, circumferentially distributed openings 118 (for example, holes indicated by small dots in FIG. 1) that are located adjacent the brush assembly 110. A bottom end 124 of the pipe segment 104 is closed off such that the cleaning fluid 112 is prevented from exiting the pipe segment 104 in the downhole direction 114. Accordingly, the cleaning fluid 112 accumulates above the bottom end 124 and is forced to exit the pipe segment 104 in a radially outward direction 116 at a high jetting force toward the internal wall surface 109 of the pipe 101. Example cleaning fluids 112 that may be pumped through the pipe segment 104 include fresh water, brine, and de-scaling mud mixtures, among others. In some examples, the cleaning fluid 112 is pumped at the rig 111 in the downhole direction 114 from a surface fluid source at a flow rate of about 5 liters per second (L/s) to about 50 L/s. In some examples, the cleaning fluid 112 flows through the openings 118 of the pipe segment 104 in the radially outward direction 116 at a fluid pressure (for example, a pump circulating pressure) of about 3 megapascals (MPa) to about 20 MPa.

The brush assembly 110 is axially positioned adjacent the openings 118 in the pipe segment 104 and includes multiple, circumferentially distributed brushes 120 that are typically made of multiple, small metal wires. The brushes 120 can be activated to mechanically scrape the debris from the internal wall surface 109 of the pipe 101 as cleaning fluid 112 is jetted from the pipe segment 104 in the radially outward direction 116. In this manner, the cleaning fluid 112 coats the brushes 120 and thereby facilitates such scraping and flow of the debris off of the internal wall surface 109. Furthermore, as the cleaning fluid 112 is jetted through the openings 118, the pipe segment 104 is rotated (for example, spun about a central axis 140) and reciprocated (for example, moved alternately between an uphole direction 122 and the downhole direction 114) within the pipe 101. Such movement of the pipe segment 104 ensures that the brushes 120 contact a substantially entire area of the setting section 103 (for example, in both axial and circumferential directions) of the internal wall surface 109 to sufficiently clean the internal wall surface 109. Combined actions of rotating the pipe segment 104, reciprocating the pipe segment 104, scraping the pipe 101 with the brush assembly 110, and forcefully flowing cleaning fluid 112 toward the internal wall surface 109 sufficiently cleans the internal wall surface 109 for adequate placement and securement of the packer 102 along the setting section 103. In the example packer installation system 100, the brush assembly 110 may be spaced apart from the packer 102 by a distance L (for example, a length extending between a vertical center point of the packer 102 and a vertical center point of the brush assembly 110) of about 5 meters (m) to about 30 m.

Figure 2:
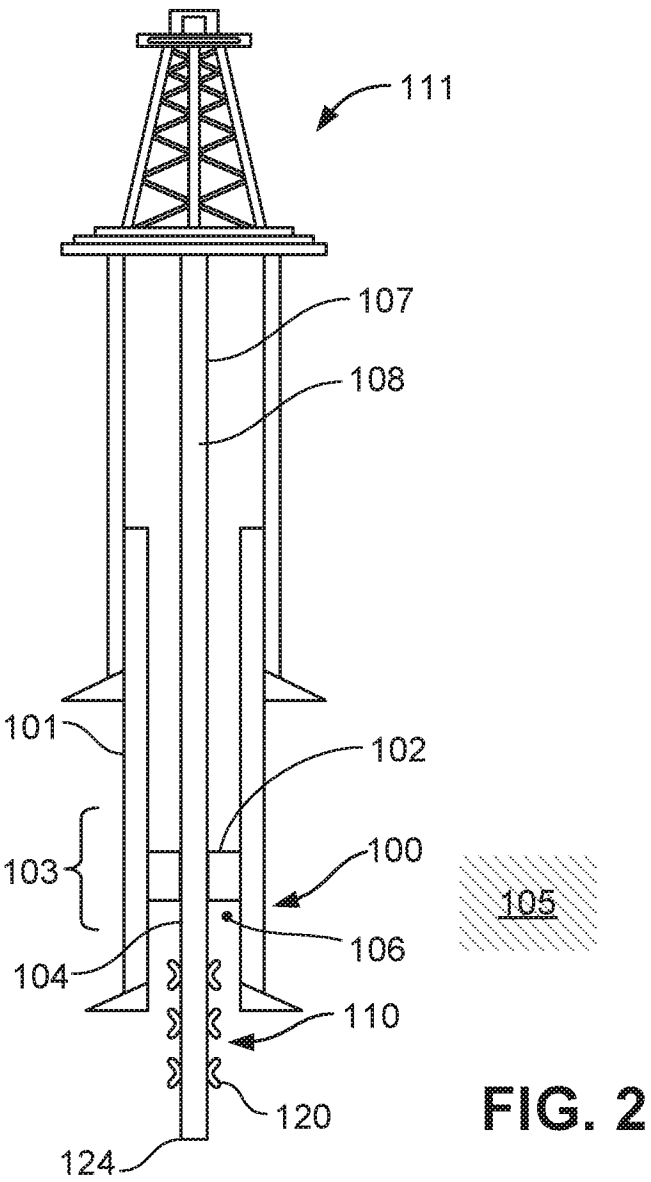
FIG. 2 is a side view of the packer installation system of FIG. 1, with the packer having been lowered to be positioned along the setting section of the pipe.

Referring to FIG. 2, once the setting section 103 has been cleaned with the brush assembly 110, the flow of cleaning fluid 118 through the drill string 107 is ceased, the pipe segment 104 is lowered to position the packer 102 along the setting section 103, and the packer 102 is set within the pipe 101. That is, the packer 102 is expanded radially outward to contact the internal wall surface 109 of the pipe 101 as part of a secure, stable connection to the pipe 101.

Figure 4:
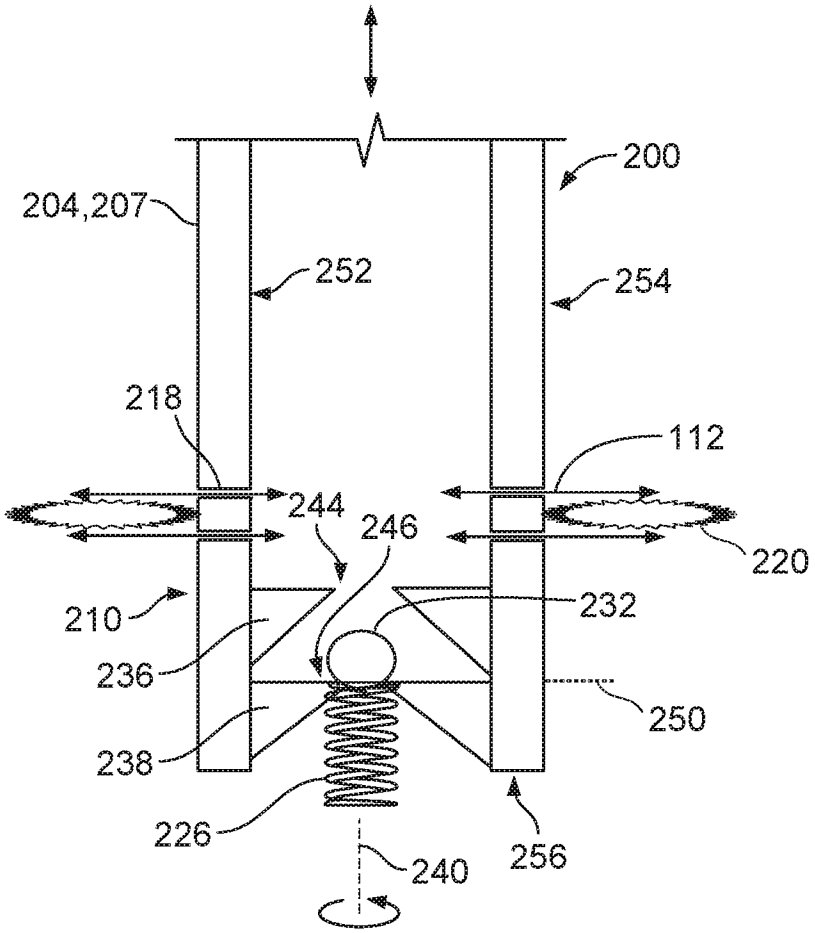
FIG. 4 is a side view of the portion of the embodiment of FIG. 3, with the brush assembly in an extended configuration.
Figure 3:
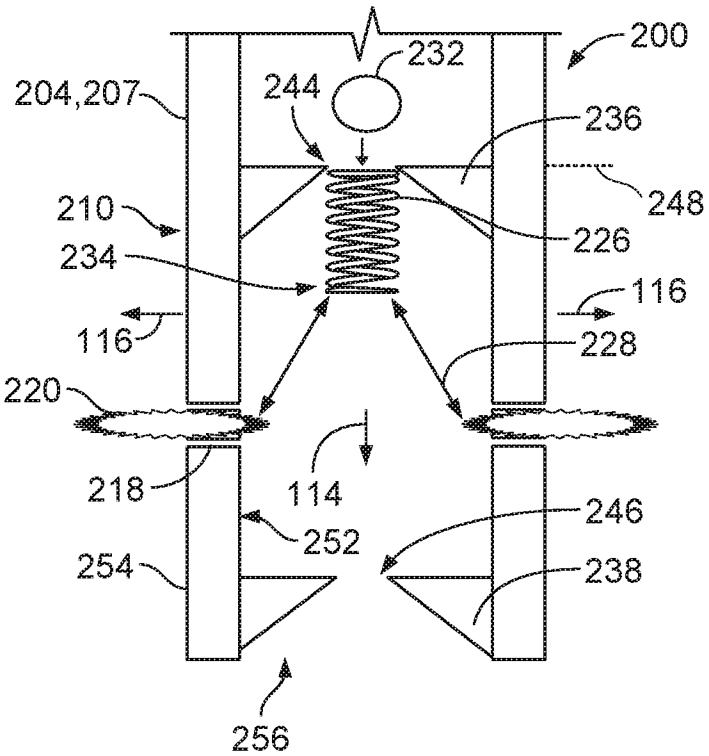
FIG. 3 is a side view of a portion of an embodiment of the packer installation system of FIG. 1, with a brush assembly in a retracted configuration.

In some embodiments, the packer installation system 100 is designed such that the pipe segment 104 has an open-bottom configuration and such that the brushes 120 are adjustable from a retracted configuration to an extended configuration. For example, the packer installation system 100 may be embodied as such a packer installation system 200, as shown in FIGS. 3 and 4. The packer installation system 200 includes the packer 102 (shown in FIG. 1), a brush assembly 210, and a pipe segment 204 of a drill string 207 to which the packer 102 and the brush assembly 210 are attached. The brush assembly 210 is positioned below and spaced apart from the packer 102 by the distance L, and the pipe segment 204 lacks a bottom wall at an open bottom end 256.

The brush assembly 210 includes multiple brushes 220 that are distributed at the same axial position along the pipe segment 204 and spaced apart substantially equidistantly about a circumference of the pipe segment 204. The brush assembly 210 typically includes a total of anywhere between 10 brushes 220 and 50 brushes 220, although only two brushes 220 are illustrated for clarity. The brush assembly 210 also includes a spring 226 that is positioned above the brushes 220, multiple pulling lines 228 that connect the spring 226 respectively to the multiple brushes 220, and a ball 232 (for example, a shear ball) that is dropped within the drill string 207 to land on an upper end of the spring 226 when a cleaning operation commences.

The spring 226 and the pulling lines 228 initially maintain the brushes 220 in a retracted configuration (as shown in FIG. 3) for tripping. For example, in the retracted configuration, the brushes 220 are positioned within a wall of the pipe segment 204 in a horizontal orientation while the drill string 207 is run into the pipe 101. Therefore, the brushes 220 do not contact the pipe 101 (for example, are spaced radially apart from the pipe 101) during tripping. The actuation system 234 is also operable to allow the brushes 220 to be adjusted from the retracted configuration to a biased, extended configuration in which the brushes 220 are positioned along and outside of an external wall surface 254 of the pipe segment 204 for operation (for example, for cleaning the internal wall surface 109 of the pipe 101). The ball 232, the spring 226, and the pulling lines 228 together form an actuation system 234 (for example, a hydraulic actuation system) that can effect the extended configuration of the brushes 220 during a cleaning operation.

The brush assembly 210 further includes a first support member 236 that supports the spring 226 at a non-functional reference position 248 (for example, an inactivated position, as shown in FIG. 3, in which the brush assembly 210 is in an inactive configuration) prior to delivery of cleaning fluid 112 to the pipe segment 204. The brush assembly 210 further includes a second support member 238 that supports the actuation system 234 at a functional position 250 (for example, an activated position, as shown in FIG. 4, in which the brush assembly 210 is in an active configuration) once the ball 232 has been dropped and has passed through the first support member 236. The first and second support members 236, 238 are respectively formed as radially symmetric bases (for example, seats) with a triangular cross-sectional profile that defines openings 244, 246. The first support member 236 is secured to an internal wall surface 252 of the pipe segment 204 via an attachment mechanism that can be overcome by a downward directed force of the ball 232 and the cleaning fluid 112 once a cleaning operation begins. Example attachment mechanisms may include an interference fit, screw fasteners, and a built-in connection. The second support member 238 is rigidly and permanently attached to the wall surface 252. For example, the second support member 238 may be permanently built-in to the pipe segment 204. The opening 244 is sized to allow through passage of the ball 232, while the opening 246 is sized to allow through passage of only the spring 226.

The actuation system 234 and the first support member 236 together remain at the reference position 248 until a pressure exerted by the cleaning fluid 112 exceeds a threshold actuation pressure of the first support member 236. In some embodiments, the threshold actuation pressure may fall in a range of about 3 MPa to about 20 MPa. Once the pressure exceeds the threshold actuation pressure, the cleaning fluid 112 forces the actuation system 234 and the first support member 236 in the downhole direction 114 until the first support member 236 abuts the second support member 238. As the actuation system 234 travels in the downhole direction 114, movement of the spring 226 past the brushes 220 exerts an increasing tension (for example, a pulling force) on the pulling lines 228 until the pulling lines 228 break (for example, snap) apart. Decoupling of the spring 226 from the brushes 220 allows the brushes 220 to move in the radially outward direction 116 from the retracted configuration in which the brushes 220 extend through the wall of the pipe segment 204 to the biased, extended configuration in which the brushes 220 are positioned along the external wall surface 254 of the pipe segment 204 and therefore contact the internal wall surface 109 of the pipe 101.

As the fluid pressure continues to build, the cleaning fluid 112 forces the ball 232 and the spring 226 through the opening 244 of the first support member 236 until the ball 232 is caught within the opening 246 of the second support member 238, thereby plugging the opening 246 at the functional position 250. Even with the fluid pressure building, the ball 232 remains at the functional position 250 because the diameter of the opening 246 is less than the diameter of the ball 232 and because the pressure of the cleaning fluid 112 will not be high enough to overcome the secure attachment of the second support member 238 to the pipe segment 204. Therefore, the ball 232 effectively closes the bottom end 256 of the pipe segment 204. The cleaning fluid 112 therefore accumulates above the second support member 238 and is forced through openings 218 in the pipe segment 204 towards the internal wall surface 109 of the pipe 101. Openings 218 are positioned axially just above and just below the brushes 220 and are positioned circumferentially in association with the brushes 220. As the cleaning fluid 112 is jetted through the openings 218, the pipe segment 204 is rotated about a central axis 240 and reciprocated within the pipe 101 while the brushes 220 mechanically scrape the internal wall surface 109 of the pipe 101 and while cleaning fluid 112 coats the brushes 220.

The components of the actuation system 234 are formed of one or more dissolvable, degradable materials that will degrade over time due to prolonged exposure to high downhole temperatures within the pipe 101. Such degradation of the components will eventually reestablish needed access to the pipe 101. Example materials from which the components may be made include aluminum, thick plastics, and low-grade metal blends.

In some embodiments, the pipe segment 204 has an internal diameter of about 5 cm to about 25 cm and a wall thickness of about 3 centimeters (cm) to about 10 cm. In some embodiments, each brush 220 has a length of about 0.1 m to about 1 m. In some embodiments, the brush assembly 210 is configured such that each brush 220 extends from the pipe segment 204 in the radially outward direction 116 by a distance of about 5 cm to about 15 cm in the retracted configuration. In some embodiments, the brush assembly 210 is configured such that each brush 220 extends from the pipe segment 204 in the radially outward direction 116 by a distance of about 5 cm to about 50 cm in the extended configuration. In some embodiments, the first support member 236 is initially spaced apart from the second support member 238 by a distance of about 3 m to about 30 m. In some embodiments, the ball 232 has a diameter of about 5 cm to about 25 cm. In some embodiments, the spring 226 has a diameter that is about equal to or less than the diameter of the ball 232. The opening 246 of the second support member 238 has a diameter of about 4 cm to about 24 cm to catch the ball 232, but to allow passage of the spring 226. In some embodiments, the pipe segment 204 has a total of four openings 218 to ten openings 218, and each opening 218 typically has a width (for example, a diameter) of about 3 cm to about 10 cm.

Figure 6:
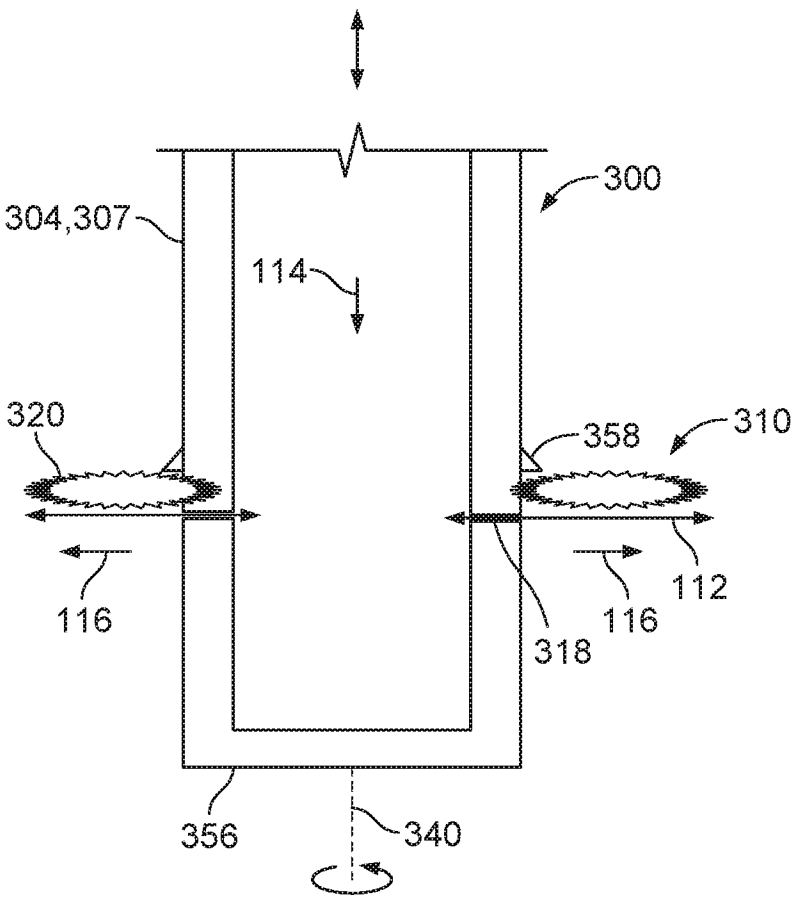
FIG. 6 is a side view of the portion of the embodiment of FIG. 5, with the brush assembly in an extended configuration.
Figure 5:
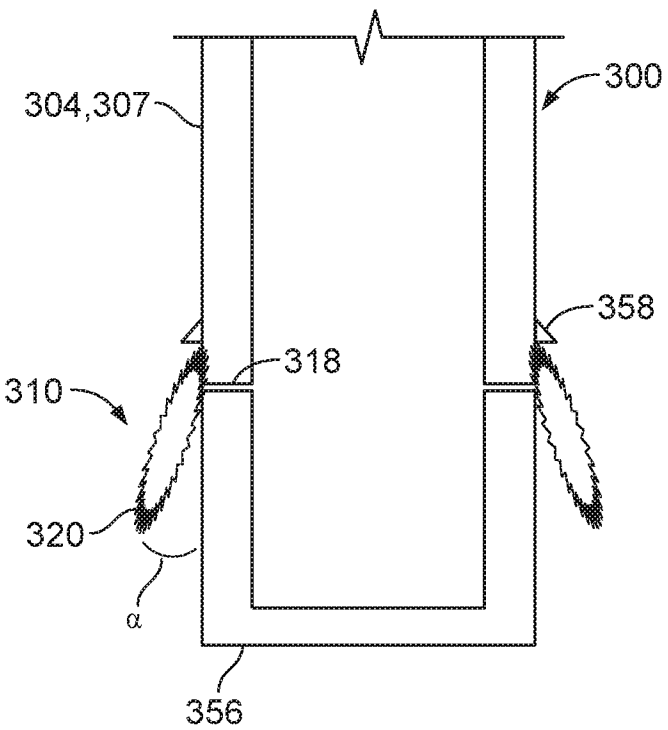
FIG. 5 is a side view of a portion of an embodiment of the packer installation system of FIG. 1, with a brush assembly in a collapsed configuration.

In some embodiments, the packer installation system 100 is designed such that the pipe segment 104 has a closed-bottom configuration and such that the brushes 120 are adjustable from a collapsed configuration to an extended configuration. For example, the packer installation system 100 may be embodied as such a packer installation system 300, as shown in FIGS. 5 and 6. The packer installation system 300 includes the packer 102 (shown in FIG. 1), a brush assembly 310, and a pipe segment 304 of a drill string 307 to which the packer 102 and the brush assembly 310 are attached. The brush assembly 310 is positioned below and spaced apart from the packer 102 by the distance L, and the pipe segment 304 has a bottom wall 356.

The brush assembly 310 includes one or more rows (for example, one or more stages) of multiple brushes 320 that are distributed at the same axial position along the pipe segment 304 and spaced equidistantly about a circumference of the pipe segment 304. The brushes 320 are attached to an external wall surface 354 of the pipe segment 304 (for example, with small metal wires that may be wrapped into a rope-like shape) and hang from the pipe segment 304 in a relaxed manner as long as the pipe segment 304 remains substantially stationary (for example, as long as the pipe segment 304 is not rotated about a central axis 340 of the pipe segment 304 or reciprocated, as shown in FIG. 5). Therefore, the brushes 320 do not contact the pipe 101 (for example, are spaced radially apart from the pipe 101) during tripping. In the collapsed configuration, the brushes 320 are typically oriented at an acute angle $\alpha$ that falls within a range of about 0 degrees (for example, with the brushes 320 oriented parallel to the central axis 340 of the pipe segment 304) to about 30 degrees with respect to the central axis 340 of the pipe segment, as illustrated in FIG. 5. The brush assembly 310 typically includes a total of anywhere between 2 brushes 320 and 10 brushes 320 per each row of brushes 320. That is, although only one row of brushes 320 is illustrated for clarity, the brush assembly 310 may include additional rows of brushes 320.

Rotation of the pipe segment 304 generates centrifugal force that acts on the brushes 320 to cause the brushes 320 to swing (for example, pivot) outward from the pipe segment 304 into the extended configuration, as shown in FIG. 6. In the extended configuration, the brushes 320 are oriented substantially horizontally to contact the internal wall surface 109 of the pipe 101. Stops 358 positioned along the exterior wall surface 354 and just above the brushes 320 limit an extent to which the brushes 320 can swing, such that the brushes 320 are oriented at an angle of at most about 90 degrees with respect to the central axis 340. Simultaneous with rotation, the pipe segment 304 may be also reciprocated within the pipe 101. Additionally, cleaning fluid 112 is pumped into the pipe segment 304 and accumulates above the bottom wall 356 of the pipe segment 304. Without any bottom opening in the pipe segment 304, the cleaning fluid 112 is forced to exit the pipe segment 304 through openings 318 in the pipe segment 304 and to flow towards the internal wall surface 109 of the pipe 101 in the radially outward direction 116. The openings 318 are positioned axially just below the brushes 320 and are positioned circumferentially in association with the brushes 320. As the cleaning fluid 112 is jetted through the openings 318, the pipe segment 304 is rotated and reciprocated within the pipe 101 while the brushes 320 mechanically scrape the internal wall surface 109 of the pipe 101 and while cleaning fluid 112 coats the brushes 320.

In some embodiments, the pipe segment 304 has an internal diameter of about 5 m to about 25 m and a wall thickness of about 3 cm to about 10 cm. In some embodiments, each brush 320 has a length of about 0.1 m to about 1 m. In some embodiments, the brush assembly 310 is configured such that each brush 320 extends from the pipe segment 304 in the radially outward direction 116 by a distance of about 5 cm to about 15 cm in the collapsed configuration. In some embodiments, the brush assembly 310 is configured such that each brush 320 extends from the pipe segment 304 in the radially outward direction 116 by a distance of about 5 cm to about 50 cm in the extended configuration. In some embodiments, the pipe segment 304 has a total of 4 openings 318 to 10 openings 318, and each opening 318 typically has a width (for example, a diameter) of about 3 cm to about 10 cm.

Figure 7:
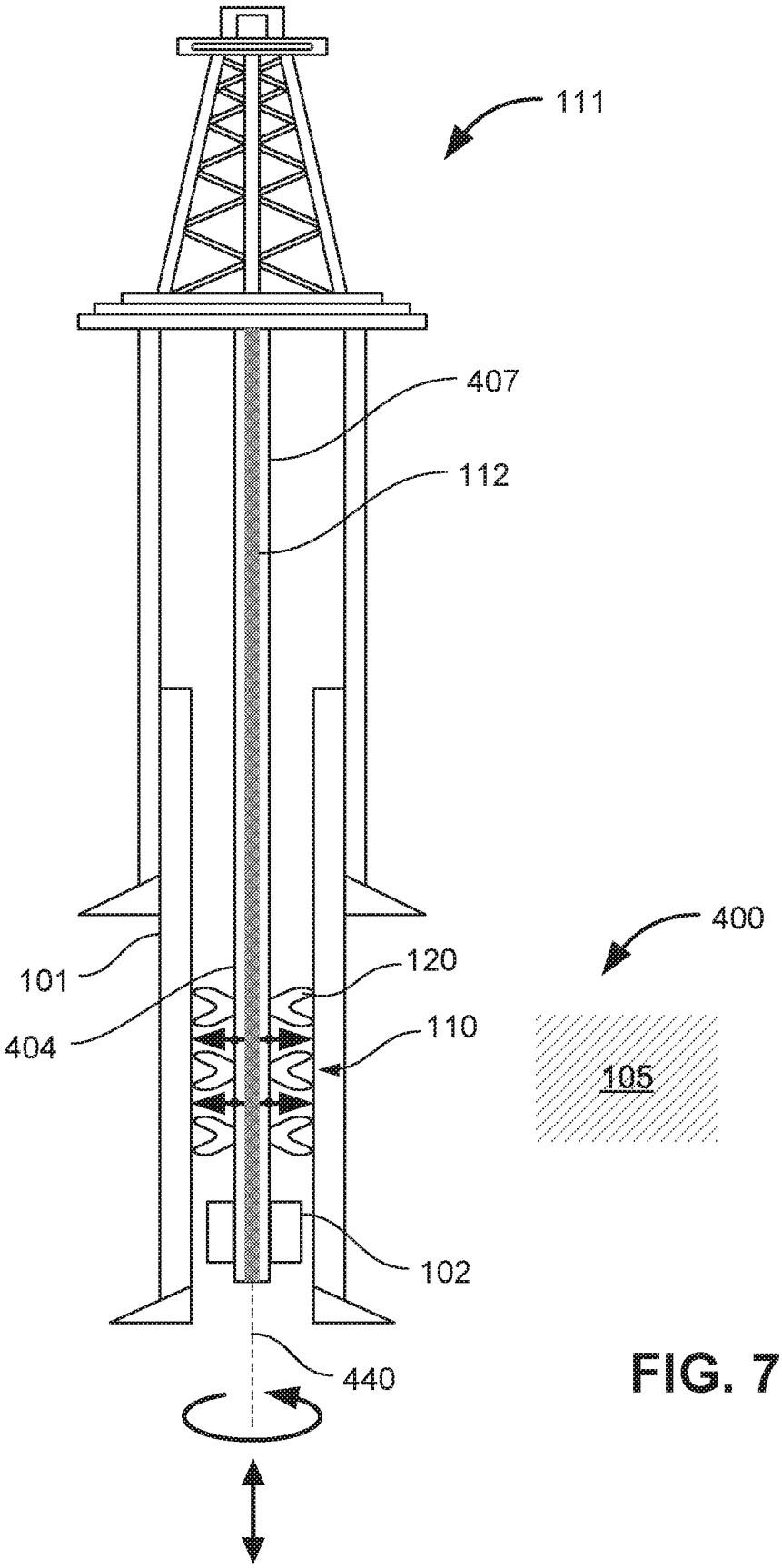
FIG. 7 is a side view of a packer installation system including a brush assembly that is positioned along a setting section of a pipe and a packer that is positioned underneath the brush assembly.

While the packer installation system 100 has been described and illustrated with the packer 102 as located above the brush assembly 110, in some embodiments, a packer installation system may alternatively include a packer 102 that is located underneath a brush assembly, as may sometimes be the case when the packer 102 is a retrievable packer used for testing purposes. For example, FIG. 7 illustrates such a packer installation system 400. The packer installation system 400 is substantially similar in construction and function to the packer installation system 100, except that the packer 102 is positioned underneath (for example, downhole of) the brush assembly 110. For example, in some embodiments, the packer 102 may be positioned just beneath and spaced apart from the packer 102 by a relatively short distance of about 3 cm to about 30 cm. Accordingly, in addition to the packer 102 and the brush assembly 110, the packer installation system 400 further includes a pipe segment 404 of a drill string 407 to which the packer 102 and the brush assembly 110 are secured. The pipe segment 404 is cleaned while being rotated about a central axis 440 and reciprocated within the pipe 101.

Once the setting section 103 of the pipe 101 has been cleaned with the brush assembly 110, the flow of cleaning fluid 118 through the drill string 407 is ceased, the pipe segment 404 is raised to position the packer 102 along the setting section 103, and the packer 102 is set within the pipe 101. As discussed above with respect to the packer installation system 100, the packer installation system 400 may be embodied as a packer installation system that includes either of the brush assemblies 210, 310.

Figure 8:
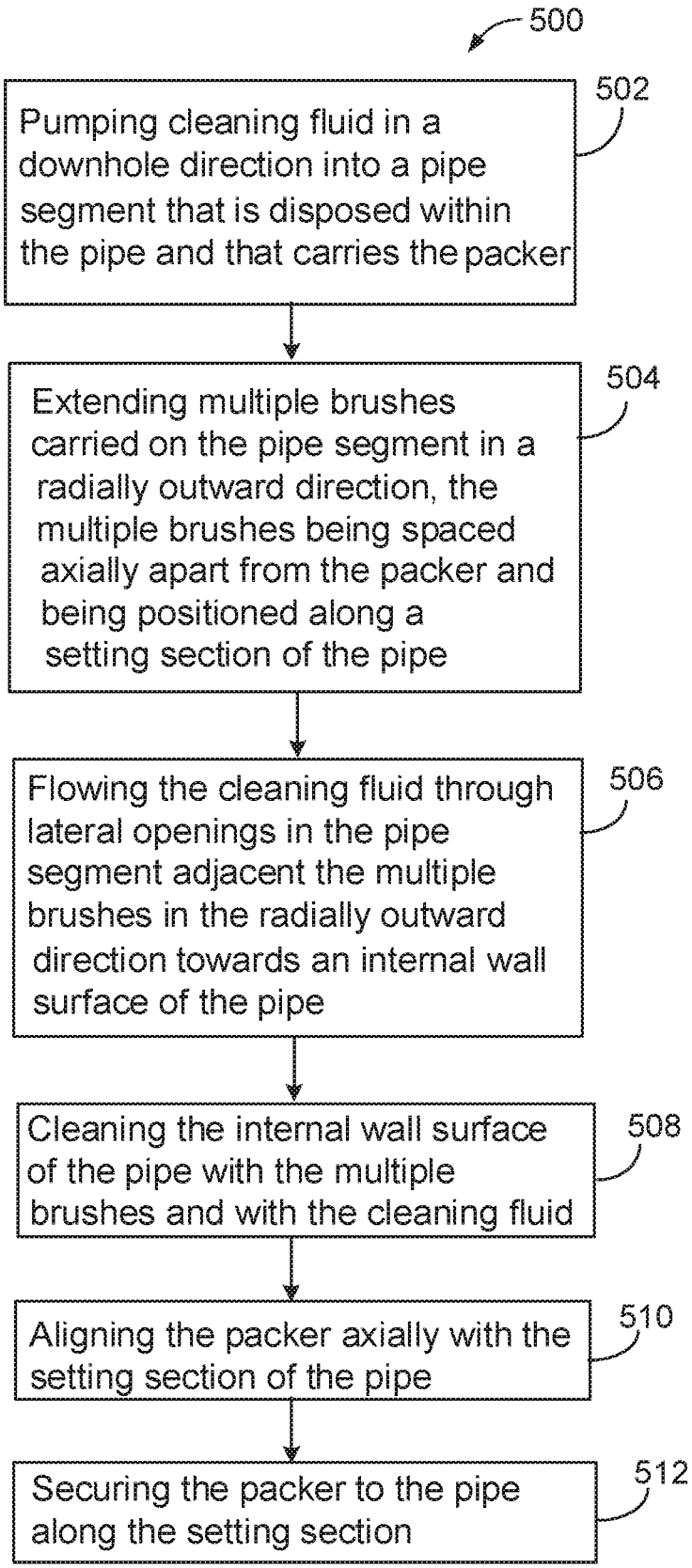
FIG. 8 is a flow chart illustrating an example method of installing a packer within a pipe.

FIG. 8 is a flow chart illustrating an example method 500 of installing a packer (for example, the packer 102) within a pipe (for example, the pipe 101). In some embodiments, the method 500 includes a step 502 for pumping cleaning fluid (for example, the cleaning fluid 112) in a downhole direction (for example, the downhole direction 114) into a pipe segment (for example, the pipe segment 104, 204, 304, 404) that is disposed within the pipe and that carries the packer. In some embodiments, the method 500 further includes a step 504 for extending multiple brushes (for example, the brushes 120, 220, 320) carried on the pipe segment in a radially outward direction (for example, the radially outward direction 116), where the brushes are spaced axially apart from the packer and positioned along a setting section (for example, the setting section 103) of the pipe. In some embodiments, the method 500 further includes a step 506 for flowing the cleaning fluid through lateral openings (for example, the openings 118, 218, 318) in the pipe segment adjacent the multiple brushes in the radially outward direction towards an internal wall surface (for example, the internal wall surface 109) of the pipe. In some embodiments, the method 500 further includes a step 508 for cleaning the internal wall surface of the pipe with the multiple brushes and with the cleaning fluid. In some embodiments, the method 500 further includes a step 510 for aligning the packer axially with the setting section of the pipe, and in some embodiments, the method 500 further includes a step 512 for securing the packer to the pipe along the setting section.

While the packer installation systems 100, 200, 300, 400 have been described and illustrated with respect to certain dimensions, sizes, shapes, arrangements, materials, and methods 500, in some embodiments, a packer installation system that is otherwise substantially similar in construction and function to any of the packer installation systems 100, 200, 300, 400 may include one or more different dimensions, sizes, shapes, arrangements, configurations, and materials or may be utilized according to different methods. Accordingly, other embodiments are also within the scope of the following claims.

What is claimed is:

1. A packer installation system, comprising:
- a pipe;
- a packer that is secured to the pipe at a first axial position along the pipe; and
- a brush assembly that is secured to the pipe at a second axial position, the brush assembly comprising brushes that are adjustable between:
  - a retracted configuration in which the brushes extend radially from the pipe by a first distance, and
  - an extended configuration in which the brushes extend radially from the pipe by a second distance that is greater than the first distance,
- wherein the brushes are biased to the extended configuration,
- wherein the brush assembly further comprises an actuation system that is coupled to the brushes in the retracted configuration, and wherein the actuation system comprises:
  - a first support member,
  - a second support member positioned axially below and spaced apart from the first support member,
  - an actuation member that is supported by the first support member when the brushes are in the retracted configuration,
  - pulling lines that connect the actuation member respectively to the brushes to secure the brushes in the retracted configuration, and
  - a shear ball that is configured to move the actuation member.

2. The packer installation system of claim 1, wherein the pipe defines a plurality of openings that are distributed about a circumference of the pipe and that are positioned adjacent the brush assembly.

3. The packer installation system of claim 1, wherein the first axial position is above the second axial position.

4. The packer installation system of claim 1, wherein the first axial position is below the second axial position.

5. The packer installation system of claim 1, wherein the pipe is open at a bottom end of the pipe.

6. The packer installation system of claim 1, wherein the brushes are oriented horizontally in both the retracted and extended configurations.

7. The packer installation system of claim 1, wherein the actuation system is configured to cause the brushes to move from the retracted configuration to the extended configuration.

8. The packer installation system of claim 1, wherein the first support member is movable in a downhole direction to abut the second support member.

9. The packer installation system of claim 8, wherein the shear ball is movable in the downhole direction from the first support member to the second support member to close a bottom end of the pipe segment.

10. The packer installation system of claim 8, wherein the actuation system is configured to cause breakage of the pulling lines to allow the brushes to move from the retracted configuration to the extended configuration.

11. The packer installation system of claim 1, wherein the actuation system is formed of one or more degradable materials.

12. The packer installation system of claim 1, wherein the pipe is closed at a bottom end of the pipe.

13. A method of installing a packer within a pipe, the method comprising:

pumping cleaning fluid in a downhole direction into a pipe segment that is disposed within the pipe and that carries the packer;

extending a plurality of brushes carried on the pipe segment in a radially outward direction from a collapsed configuration to an extended configuration, wherein the plurality of brushes is spaced axially apart from the packer and positioned along a setting section of the pipe, wherein, in the collapsed configuration, the plurality of brushes extends radially from the pipe by a first distance and is oriented at an acute angle with respect to the central axis of the pipe, wherein, in the extended configuration, the plurality of brushes is oriented at an angle of about 90 degrees with respect to a central axis of the pipe;

flowing the cleaning fluid through lateral openings in the pipe segment adjacent the plurality of brushes in the radially outward direction towards an internal wall surface of the pipe;

cleaning the internal wall surface of the pipe with the plurality of brushes and with the cleaning fluid;

aligning the packer axially with the setting section of the pipe; and securing the packer to the pipe along the setting section.

14. A packer installation system, comprising:

a pipe;

a packer that is secured to the pipe at a first axial position along the pipe; and a brush assembly that is secured to the pipe at a second axial position, the brush assembly comprising brushes that are adjustable between:

a collapsed configuration in which the brushes extend radially from the pipe by a first distance, and an extended configuration in which the brushes extend radially from the pipe by a second distance that is greater than the first distance, wherein the brushes are oriented at an angle of about 90 degrees with respect to a central axis of the pipe in the extended configuration, and wherein the brushes are oriented at an acute angle with respect to the central axis of the pipe in the collapsed configuration.

15. The packer installation system of claim 14, wherein the brushes are configured to pivot radially outward from the collapsed configuration to the extended configuration.

16. The packer installation system of claim 15, wherein the brush assembly further comprises stops that are positioned to prevent the brushes from swinging more than 90 degrees away from the pipe segment in the extended configuration.

* * * * *